US009296530B2

(12) United States Patent
Cockerham et al.

(10) Patent No.: US 9,296,530 B2
(45) Date of Patent: Mar. 29, 2016

(54) THIEF HATCH

(71) Applicant: Enardo LLC, Tulsa, OK (US)

(72) Inventors: John David Cockerham, Tulsa, OK (US); George Donald Jones, Sapulpa, OK (US); Johnny Marvin Bowyer, Jr., Tulsa, OK (US)

(73) Assignee: Regulator Technologies Tulsa LLC, Tulsa, OK (US)

( * ) Notice: Subject to any disclaimer, the term of this patent is extended or adjusted under 35 U.S.C. 154(b) by 0 days.

(21) Appl. No.: 13/857,010

(22) Filed: Apr. 4, 2013

(65) Prior Publication Data

US 2013/0264341 A1 Oct. 10, 2013

Related U.S. Application Data

(60) Provisional application No. 61/621,235, filed on Apr. 6, 2012.

(51) Int. Cl.

| | |
|---|---|
| ***B65D 51/16*** | (2006.01) |
| ***B65D 47/32*** | (2006.01) |
| ***B65D 90/10*** | (2006.01) |
| ***B65D 90/34*** | (2006.01) |

(52) U.S. Cl.

CPC ..... *B65D 47/32* (2013.01); *B65D 90/105* (2013.01); *B65D 90/34* (2013.01)

(58) Field of Classification Search

CPC ..... B65D 47/32; B65D 90/34; B65D 90/105
USPC ..... 220/203.23, 203.29, 203.24, 203.27, 220/203.28, 204, 203.18, 203.01; 105/377.05; 137/38, 39, 43, 514.3, 137/467, 492.5, 315.35

See application file for complete search history.

(56) References Cited

U.S. PATENT DOCUMENTS

| | | | | | |
|---|---|---|---|---|---|
| 1,740,838 | A | * | 12/1929 | Roesen | 464/33 |
| 1,891,119 | A | * | 12/1932 | Stover | 137/467 |
| 2,183,448 | A | * | 12/1939 | Brooks | 220/203.26 |
| 2,309,238 | A | * | 1/1943 | Corey | 403/2 |
| 3,064,350 | A | * | 11/1962 | Wertepny, Sr. et al. | 30/248 |
| 3,209,392 | A | * | 10/1965 | Levine | 16/289 |
| 3,263,698 | A | * | 8/1966 | Siggelin | 137/467 |

(Continued)

FOREIGN PATENT DOCUMENTS

| | | | |
|---|---|---|---|
| CN | 201712993 | U | 1/2011 |
| WO | 00/40482 | A1 | 7/2000 |

OTHER PUBLICATIONS

International Search Report for PCT Application No. PCT/US2013/035434 dated Jul. 26, 2013, 6 pgs.

(Continued)

*Primary Examiner* — Anthony Stashick
*Assistant Examiner* — James M Van Buskirk
(74) *Attorney, Agent, or Firm* — Marshall, Gerstein & Borun LLP

(57) ABSTRACT

Embodiments of the present disclosure are directed towards a venting hatch having a base configured to couple to a storage container, wherein the base comprises a central opening configured to be exposed to an opening of the storage container, a cap coupled to the base, a seal disposed between the base and the cap, and an actuating mechanism configured to exert a biasing force on the seal to bias the seal against an annular lip of the base, wherein the actuating mechanism is disposed on an exterior surface of the cap.

20 Claims, 5 Drawing Sheets

(56) References Cited

U.S. PATENT DOCUMENTS

| | | | | | |
|---|---|---|---|---|---|
| 3,290,003 | A | * | 12/1966 | Kessler | 251/318 |
| 3,592,222 | A | * | 7/1971 | Goss et al. | 137/467 |
| 3,653,684 | A | * | 4/1972 | Plumer | 280/734 |
| 3,934,911 | A | * | 1/1976 | Oehlerking | 293/103 |
| 4,513,779 | A | * | 4/1985 | Owoc et al. | 137/556 |
| 4,555,041 | A | * | 11/1985 | Muehl | 220/203.2 |
| 4,768,675 | A | | 9/1988 | Coleman | |
| 4,884,709 | A | * | 12/1989 | McCarthy | 220/565 |
| 5,048,553 | A | * | 9/1991 | VanDeVyvere | 137/43 |
| 5,094,267 | A | * | 3/1992 | Ligh | 137/488 |
| 5,275,202 | A | * | 1/1994 | VanDeVyvere | 137/492 |
| 6,634,677 | B2 | * | 10/2003 | Mehr | 285/305 |
| 2011/0056938 | A1 | | 3/2011 | Petrarca et al. | |
| 2011/0079292 | A1 | | 4/2011 | Nunez | |

OTHER PUBLICATIONS

Chinese Office Action from Application No. 201380029702.6 dated Dec. 23, 2015.

* cited by examiner

THIEF HATCH

CROSS REFERENCE TO RELATED APPLICATIONS

This application is a Non-Provisional Patent Application of U.S. Provisional Patent Application No. 61/621,235, entitled "Thief Hatch", filed Apr. 6, 2012, which is herein incorporated by reference.

BACKGROUND OF THE INVENTION

The subject matter disclosed herein relates to storage tanks and, more specifically, to thief hatches for storage tanks.

Storage tanks, such as an above-ground or below-ground storage tank, may include openings designed to accept a venting device, such as a thief hatch, to provide access to the interior of the storage tank. For example, a thief hatch may provide a resealable opening through which a thief or other tool may be inserted into the interior of the storage tank.

As will be appreciated, the internal pressure (e.g., internal vapor pressure) of storage tanks may vary and may depend on various factors, such as the amount of fluid in the storage tank, the volatility of the fluid in the storage tank, temperature of the fluid in the storage tank, temperature outside the storage tank, thermal conductivity of the walls of the storage tank, and so forth. Accordingly, excessive vapor pressure in the storage tank may be relieved (e.g., in a controlled fashion). For example, a thief hatch may provide a seal that blocks fluid communication between the interior of the storage tank and the exterior of the storage tank when the vapor pressure within the tank is below a threshold and enables fluid communication between the interior of the storage tank and the exterior of the storage tank when the vapor pressure within the tank is above the threshold.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a system includes a thief hatch. The thief hatch includes a base configured to couple to a storage container, wherein the base comprises a central opening configured to be exposed to an opening of the storage container, a cap coupled to the base, a seal disposed between the base and the cap, and an actuating mechanism configured to exert a biasing force on the seal to bias the seal against an annular lip of the base, wherein the actuating mechanism is disposed on an exterior surface of the cap.

In a second embodiment, a venting hatch includes a base comprising an annular lip defining a central opening, wherein the central opening is configured to be in fluid communication with an interior of a container, a lid coupled to the base by a hinge, a seal assembly disposed between the base and the lid and configured to abut the annular lip to create a sealing interface, and an actuating mechanism coupled to a side of the lid opposite the seal assembly, wherein the actuating mechanism is configured to exert a biasing force on the seal assembly in the direction of the annular lip.

In a third embodiment, a system includes a storage container and a venting hatch. The storage container includes an interior volume and an opening exposing the interior volume to an environment surrounding the storage container. The venting hatch includes a base coupled to the storage container about the opening, wherein the base comprises a central passage in fluid communication with the opening, a cap hinged to the base, wherein the cap is configured to expose the opening in an open position and block the opening in a closed position, a seal assembly disposed between the base and the cap, wherein the seal assembly is configured to create a sealing interface with base to seal the central passage, and an actuating mechanism disposed on an exterior side of the cap, wherein the actuating mechanism is configured to apply an axial biasing force on the seal assembly.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

Embodiments of the present disclosure are directed toward an improved thief hatch or venting device for a storage tank. For example, in certain embodiments, the thief hatch may have an actuating mechanism that is external to the storage tank when the thief hatch is installed onto the storage tank. As such, in the manner described in detail below, the actuating mechanism may be maintained, removed, and/or replaced, while maintaining a sealing relationship between the thief hatch and the storage tank (e.g., without opening the thief hatch). Additionally, a sealing mechanism of the thief hatch may be self-leveling and seal-centering, thereby maintaining an even, axially downward force on the seal between the thief hatch and the storage tank. Furthermore, the thief hatch may have a quick release mechanism configured to actuate when an internal pressure of the storage tank exceeds an elevated threshold pressure. In this manner, the storage tank may be further protected from elevated internal pressures.

Figure 1:
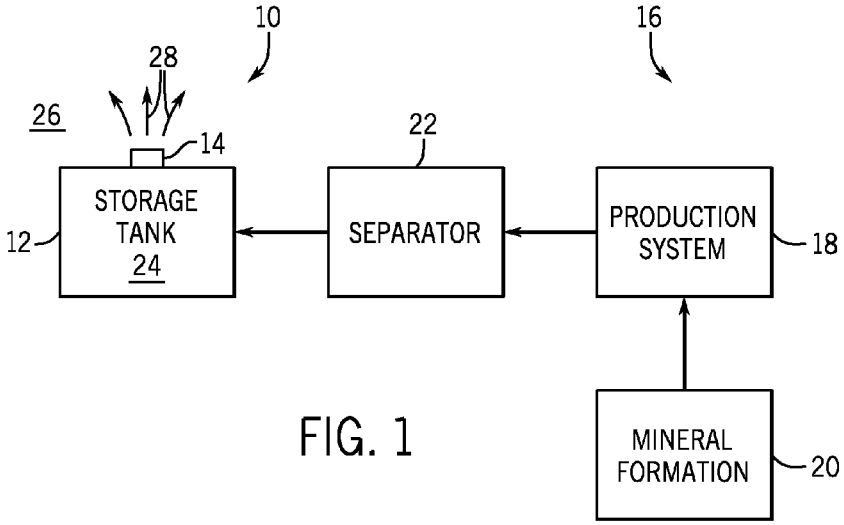
FIG. 1 is a schematic of a storage tank system having a thief hatch or venting device, in accordance with an embodiment of the present disclosure.

FIG. 1 is a schematic of a storage tank system 10 having a storage tank 12 and an improved thief hatch 14. As will be appreciated, the storage tank system 10 may be a component of a variety of applications. In the illustrated embodiment, the storage tank system 10 is a component of a mineral recovery system 16, which includes a production system 18 configured to recover a mineral (e.g., oil and/or gas) from a mineral formation 20, such as a well. As the production system 18 recovers minerals from the mineral formation 20, the minerals recovered may be processed in a separator 22. Specifically, the separator 22 is designed to separate production fluids into their constituent components. For example, production fluids may be separated into oil, gas, fracking fluid, and water components. Thereafter, a constituent component or fluid separated by the separator 22 may be flowed into the storage tank 12 for storage.

When a fluid is stored in the storage tank 12, pressure may build within the storage tank 12. For example, the separator 20 may discharge the fluid for storage into the storage tank 12 at an elevated pressure. In certain embodiments, it may be desirable to vent or release pressures within an interior 24 of the storage tank 12 that are above a threshold pressure (e.g., a venting threshold pressure). As such, the storage tank 12 includes the thief hatch 14, which is configured to open (e.g., periodically open) fluid communication between the interior 24 of the storage tank 12 and an environment 26 external to the storage tank 12. In particular, the thief hatch 14 may be configured to open fluid communication between the interior 24 of the storage tank 12 and the environment 26 surrounding the storage tank 12 when the pressure within the interior 24 of the storage tank 12 exceeds a threshold pressure. In this manner, vapor or fluid may be vented from the storage tank 12, as indicated by arrows 28, thereby decreasing the internal pressure of the storage tank 12. Once the internal pressure of the storage tank 12 falls below the threshold pressure, the seal assembly of the thief hatch 14 may automatically close and re-seal, thereby blocking fluid communication between the interior 24 of the storage tank 12 and the external environment 26. As discussed in detail below, the thief hatch 14 may have various features to improve operation, reliability, maintenance, and performance of the thief hatch 14. For example, the thief hatch 14 may have an actuating mechanism that is external to the storage tank 12 when the thief hatch 14 is installed on the storage tank 12. Additionally, the thief hatch 14 may have a self-leveling and self-centering sealing mechanism and/or a quick release mechanism configured to actuate when an internal pressure of the storage tank 12 exceeds an elevated threshold pressure (e.g., a threshold pressure greater than the venting threshold pressure).

Figure 2:
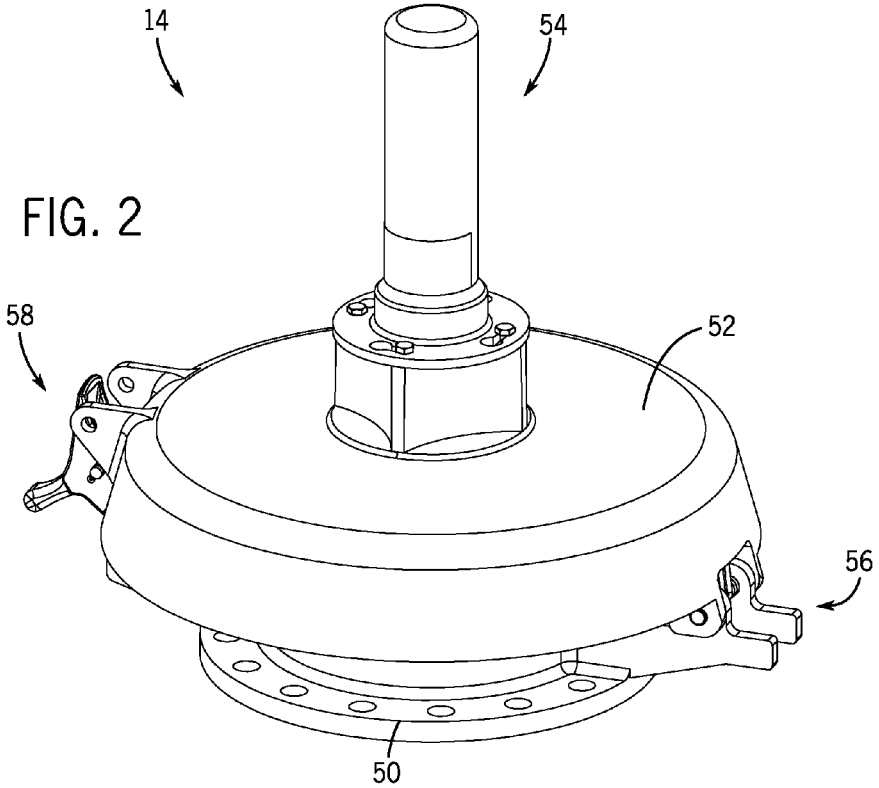
FIG. 2 is a perspective view of a thief hatch, in accordance with an embodiment of the present disclosure.

FIG. 2 is a perspective view of an embodiment of the thief hatch 14. As shown, the thief hatch 14 includes a base 50, a cap 52, and an actuating mechanism 54. More specifically, the cap 52 is coupled to the base 50 by a hinged connection 56 and a releasable latch 58. When the thief hatch 14 is installed onto the storage tank 12, the base 50 is disposed about an opening of the storage tank 12, and the base 50 is mechanically attached to the storage tank 12. For example, the base 50 may be coupled to the storage tank 12 by bolts, rivets, welds, or other suitable means. In operation, the thief hatch 14 is configured to seal the opening of the storage tank 12. In other words, the thief hatch 14 blocks fluid communication between the interior 24 of the storage tank 12 and the environment 26 surrounding the storage tank 12, as discussed above. Additionally, to enable the passage of a tool or other instrument through the opening of the storage tank 12, the releasable latch 58 may be released, and the cap 52 may pivot about the hinged connection 56 and relative to the base 50. In this manner, the cap 52 and a seal assembly of the thief hatch 14 may expose the opening of the storage tank 12, thereby enabling an operator to position a tool or other instrument into the storage tank 12.

Furthermore, as mentioned above, the thief hatch 14 includes the actuating mechanism 54. Specifically, the actuating mechanism 54 is disposed on an exterior of the thief hatch 14. In the manner described in detail below, the exterior location of the actuating mechanism 54 enables maintenance and/or replacement of the actuating mechanism 54 without opening the thief hatch 14. In other words, a seal interface of the thief hatch 14 blocking fluid communication between the interior 24 of the storage tank 12 and the environment 26 surrounding the storage tank 12 may be maintained while the actuating mechanism 54 is maintained, removed, or replaced. Additionally, as the actuating mechanism 54 is external to the storage tank 12, the actuating mechanism 54 and its components may not be exposed to the contents of the storage tank 12. As a result, the risk of corrosion of the actuating mechanism 54 and its components may be reduced.

Figure 3:
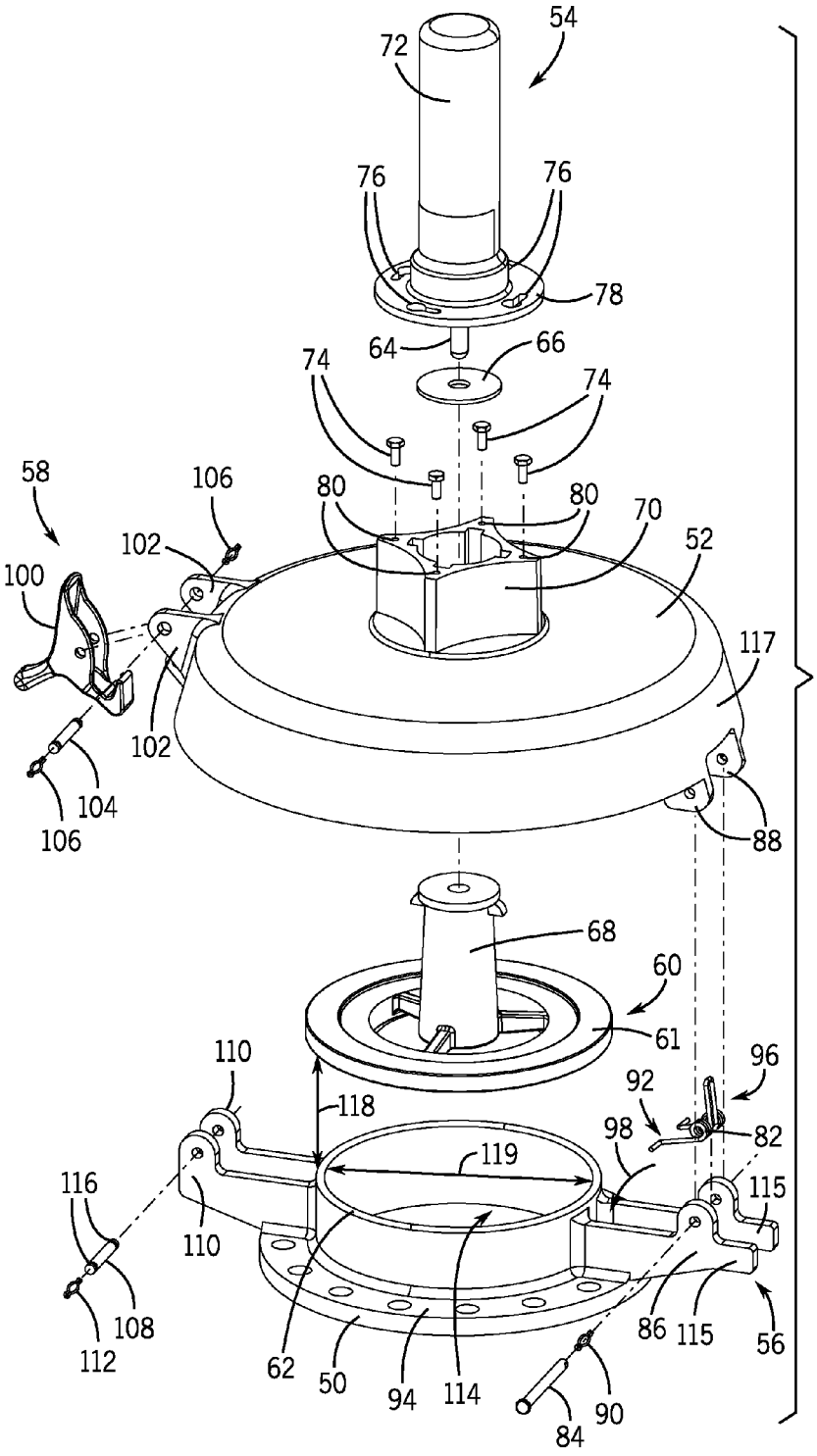
FIG. 3 is an exploded perspective view of the thief hatch of FIG. 2, in accordance with an embodiment of the present disclosure.

FIG. 3 is an exploded perspective view of an embodiment of the thief hatch 14, illustrating various components of the thief hatch 14. As discussed above, the thief hatch 14 includes the base 50, which may be mechanically attached to the storage tank 12 when the thief hatch 14 is installed. The thief hatch 12 also includes the cap 52 and the actuating mechanism 54. Additionally, the thief hatch 14 includes a seal assembly 60 (e.g., a seal) disposed between the base 50 and the cap 52. In certain embodiments, the seal assembly 60 may include a pressure-activated envelope gasket that is captured by a gland during venting of the storage tank 12 to reduce deflection of the envelope gasket.

When the thief hatch 14 is installed, the seal assembly 60 (e.g., a sealing disk 61 of the seal assembly 60) abuts an annular lip 62 of the base 50. In particular, the actuating mechanism 54 may apply a downward, axial force on the seal assembly 60, as described below, thereby biasing the seal assembly 60 (e.g., the sealing disk 61) against the annular lip 62. For example, the actuating mechanism 54 may include a spring that applies an axial, downward force on an actuating stem 64 of the actuating mechanism 54. The actuating stem 64 may engage with a center pad 66 that abuts a central extrusion 68 of the seal assembly 60. As a result, the actuating stem 64 and the center pad 66 may transfer the axial, downward force of the spring to the seal assembly 60, thereby creating a sealing interface between the seal assembly 60 (e.g., the sealing disk 61) and the annular lip 62 of the base 50. In this manner, the seal assembly 60 may block fluid communication between the interior 24 of the storage tank 12 and the environment 26 surrounding the storage tank 12. As further discussed below, the quantity or amount of the axial, downward force applied to the seal assembly 60 by the actuating mechanism 54 may be designed or selected based on a particular storage tank 12 application.

As shown, the cap 52 of the thief hatch 14 includes an extruded mounting portion 70 to which the actuating mechanism 54 may be mounted. For example, a shell 72 of the actuating mechanism 54 may be fastened to the extruded mounting portion 70 of the cap 52 by fasteners 74 (e.g., bolts, screws, or other mechanical fasteners). Specifically, the fasteners 74 may extend through apertures 76 formed in a flange 78 of the shell 72, and the fasteners 74 may engage with holes 80 formed in the extruded mounting portion 70 of the cap 52. As discussed below with respect to FIG. 4, the apertures 76 formed in the flange 78 of the shell 72 may have a geometry that enables the decoupling of the shell 72 and the actuating mechanism 54 from the cap 52 without completely removing the fasteners 74 from the holes 80 formed in the extruded mounting portion 70 of the cap 52. As a result, removal of the actuating mechanism 54 from the cap 52 may be simplified.

As mentioned above, the external position of the actuating mechanism 54 with respect to the storage tank 12 enables the removal of the actuating mechanism 54 from the thief hatch 14, while maintaining a sealing interface between the seal assembly 60 (e.g., the sealing disk 61) and the annular lip 62 of the base 50. In particular, when the actuating mechanism 54 is removed, the weight of the seal assembly 60 may cause the seal assembly 60 to remain rested against the annular lip 62 of the base 50. As a result, the thief hatch 14 may remain closed, and the sealing interface between the seal assembly 60 and the annular lip 62 of the base 50 may be maintained. In this manner, the risk of contaminating the storage tank 12 contents and the risk of releasing vapors from the storage tank 12 into the environment 26 while the actuating mechanism 54 is maintained, removed, and/or replaced may be reduced.

As mentioned above, the thief hatch 14 includes the hinged connection 56 and the releasable latch 58. As shown in the illustrated embodiment, the hinged connection 56 includes a hinge spring 82, which may be positioned about a clevis pin 84 and between two hinge flanges 86 of the base 50. The clevis pin 84 may further extend through the two hinge flanges 86 of the base 50 and through two hinge flanges 88 of the cap 52. In certain embodiments, a cotter pin 90 may be used to hold the clevis pin 84 in place.

When the components of the hinged connection 56 are assembled, a first end 92 of the hinge spring 82 engages with a flange 94 of the base 50, and a second end 96 of the hinge spring 82 engages with an interior of the cap 52. As will be appreciated, the hinge spring 82 will exert force on the flange 94 of the base 50 and the interior of the cap 52. In particular, the forces exerted by the hinge spring 82 on the base 50 and the cap 52 may counter act a rotating moment (e.g., indicated by arrow 98) acting on the cap 52 and caused by the weight of the cap 52. As a result, the hinge spring 82 may function to level the cap 52 when the cap 52 is coupled to the base 52 by the releasable latch 58 (e.g., when the cap 52 is in a closed position).

Furthermore, the releasable latch 58 includes a latch 100 that is coupled to the cap 52 (e.g., in between latch flanges 102) by a latch pin 104. The latch pin 104 may be held in place by retaining clips 106. To couple the cap 52 to the base 50, the latch 106 may engage with and grab a clevis pin 108 positioned between two latch flanges 110 of the base 50. As similarly described above, the clevis pin 108 may be held in place between the two latch flanges 110 of the base 50 by a cotter pin 112. To release the latch 100 and open the thief hatch 14, the latch 100 may be rotated about the latch pin 104, and the latch 100 may be disengaged from the clevis pin 108. With the latch 100 disengaged from the clevis pin 108, the forces exerted by the hinge spring 82 on the base 50 and the cap 52 may enable the cap 52 to pivot and rotate about the clevis pin 84. In this manner, the seal assembly 60, cap 52, and actuating mechanism 54 may be rotated to expose a central opening 114 of the base 50. As will be appreciated, the central opening 114 of the base 50 may be in fluid communication with the interior 24 of the storage tank 12. With the central opening 114 and the interior 24 of the storage tank 12 exposed, a tool or instrument may be inserted into the storage tank 12.

In certain embodiments the clevis pin 108 may be scored. That is, the clevis pin 108 may have one or more indentions 116. The indentions 116 may enable the clevis pin 108 to shear when a force above a threshold force is applied to the clevis pin 108. For example, the threshold force may be a quantity of force acting on the clevis pin 108 when the thief hatch 14 is latched (e.g., the cap 52 is in the closed position and the releasable latch 58 is engaged) and the internal pressure of the storage tank 12 reaches an elevated threshold (e.g., a threshold greater than the threshold pressure that actuates the venting of the seal assembly 60). In such a circumstance, the clevis pin 108 may shear, thereby opening the thief hatch 14 and enabling accelerated venting of the storage tank 12. In other words, when the clevis pin 108 shears, the thief hatch 14 may be fully opened, thereby moving the cap 52, the seal assembly 60, and the actuating mechanism 54 to expose the interior 24 of the storage tank 12 to the environment 26 surrounding the storage tank 12.

Moreover, the hinge flanges 86 may each include an extension 115 configured to stop rotation of the cap 52 when the cap 52 is rotated into the open position. Specifically, the extension 115 of each of the hinge flanges 86 may contact an outer lip 117 of the cap 52 when the cap 52 is rotated into the open position. In this manner, the extensions 115 may block the cap 52 from rotating beyond a desired or particular point, thereby blocking contact between the storage tank 12 and the actuating mechanism 54.

Furthermore, in the manner described below, the actuating mechanism 54 may be configured to enable a high lift of the seal assembly 60 during venting of the storage tank 12. For example, the actuating mechanism 54 may enable the seal assembly 60 to lift a distance 118, which may be approximately equal to or greater than 25% of a diameter 119 of the central opening 114. As a result, the thief hatch 14 may enable accelerated venting of the storage tank 12. In other words, the thief hatch 14 may have increased pressure venting capacity.

Figure 4:
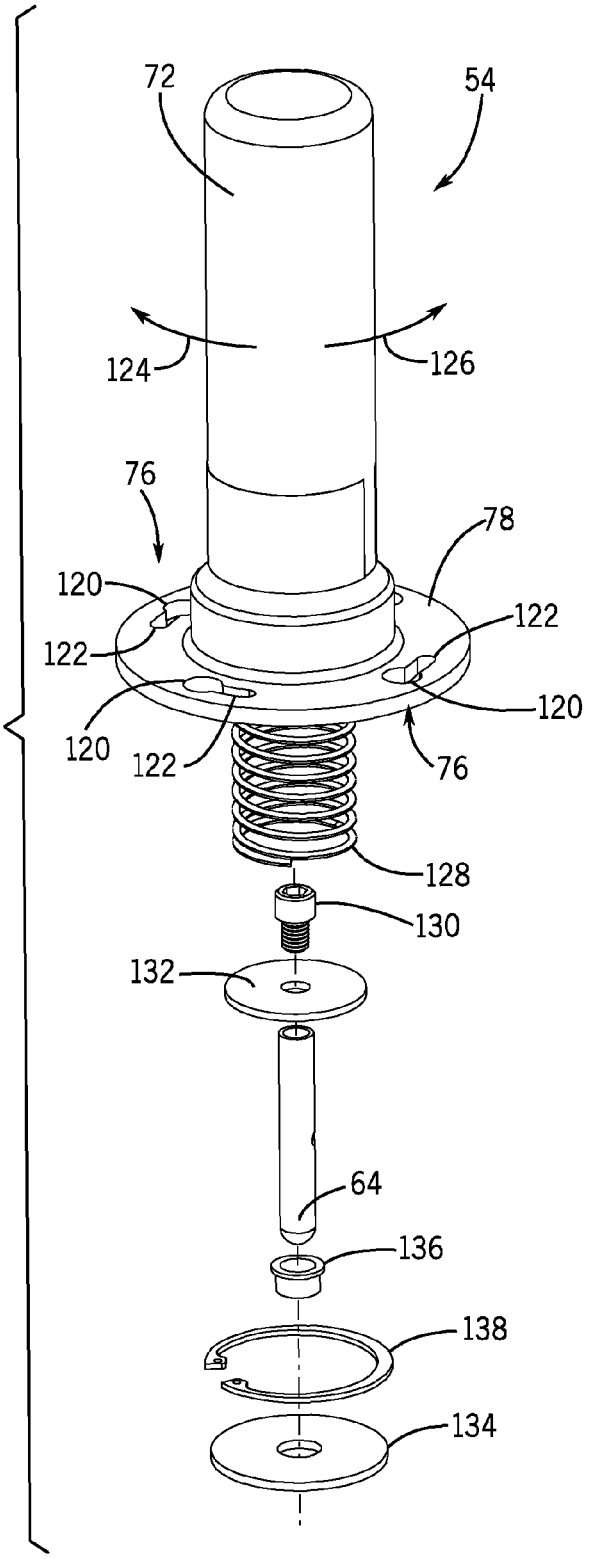
FIG. 4 is an exploded perspective view of an actuating mechanism of the thief hatch of FIG. 2, in accordance with an embodiment of the present disclosure.

FIG. 4 is an exploded perspective view of an embodiment of the actuating mechanism 54. As mentioned above, the actuating mechanism 54 includes the shell 72, which is configured to be coupled to the extruded mounting portion 70 of the cap 52. In particular, fasteners 74 may extend through the apertures 76 formed in the flange 78 of the shell 72, and the fasteners 74 may be attach to the extruded mounting portion 70 (e.g., in holes 80). Additionally, as mentioned above, the apertures 76 may have a geometry that enables removal of the shell 72 from the extruded mounting portion 70 without decoupling the fasteners 74 from the holes 80 in the extruded mounting portion 70. More specifically, each aperture 76 includes a wide portion 120 and a narrow portion 122. The wide portion 120 of each aperture 76 may be large enough that the wide portion 120 may extend over a head of one of the fasteners 74. Thereafter, the shell 72 may be rotated or twisted, as indicated by arrow 124, and the narrow portion 122 may be disposed beneath the head of one of the fasteners 74. In this manner, the head of the fastener 74 may engage with the flange 78 of the shell 72, thereby restricting axial movement of the shell 72. With one of the fasteners 74 engaged with the narrow portion 122 of each of the apertures 76, the fasteners 74 may be tightened, and the shell 72 may be fixedly attached to the cap 52. As will be appreciated, to remove the shell 72 from the cap 52, the fasteners 74 may be loosened, but not necessarily removed completely from the holes 80 in the extruded mounting portion 70. With the fasteners 74 loosened, the shell 72 may be rotated as indicated by arrow 126, thereby exposing the wide portion 120 of each aperture 76 to a respective head of each fastener 74 and enabling removal of the shell 72 from the extruded mounting portion 70 (e.g., in an axial, upward).

As mentioned above, the actuating mechanism 54 is configured to exert a downward, axial force on the seal assembly 60 (e.g., seal assembly). Specifically, the actuating mechanism 54 includes the actuating stem 64, which applies the downward, axial force onto the center pad 66. The downward, axial force may be generated by one or more of a variety of mechanisms. For example, in the illustrated embodiment, the downward, axial force is generated by a spring 128 (e.g., a fixed-pressure spring) that is housed within the shell 72. However, in other embodiments, the downward, axial force may be generated by a field-adjustable spring, a pilot operator utilizing an external pressure sensor, an actuator utilizing pressurized media, such as hydraulic, pneumatic, or steam, an electric actuator, or other suitable actuator. In the illustrated embodiment, the actuating mechanism 54 further includes a screw 130 coupled to the actuating stem 64, washers 132 and 134, and a bearing 136, which are held within the shell 72 by a retaining ring 138. Additionally, the screw 130 may restrain the washer 132 against the actuating stem 64. As mentioned above, the actuating mechanism 54 may enable the seal assembly 60 to have a high lift. For example, the seal assembly 60 may be able to lift the distance 118, which may be approximately equal to or greater than 25% of a diameter 119 of the central opening 114. To this end, the spring 128 or other actuator may have a length or range of motion selected to enable a high lift of the seal assembly 60.

Figure 5:
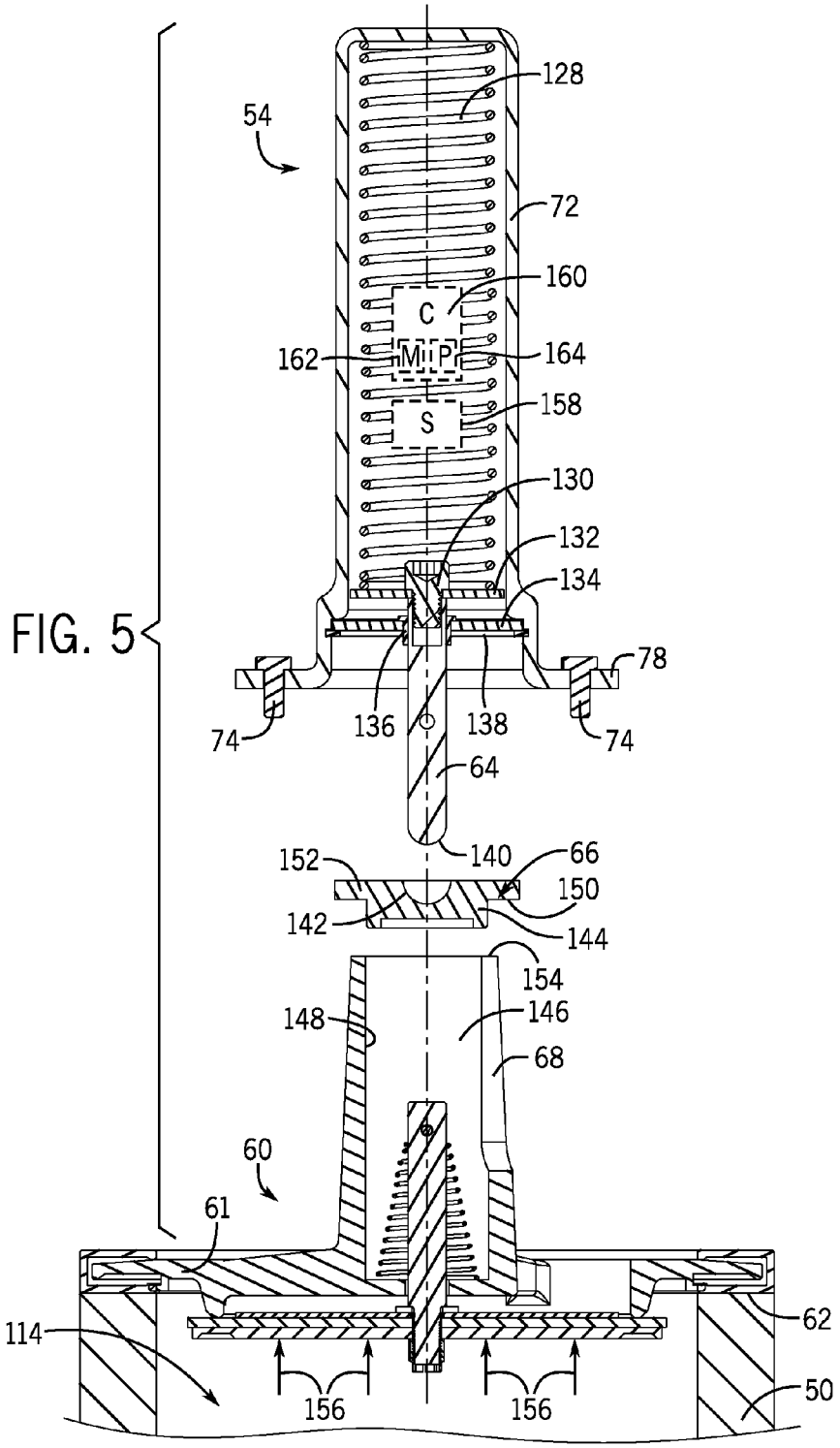
FIG. 5 is a partial cross-sectional side view of the thief hatch, in accordance with an embodiment of the present disclosure.

FIG. 5 is a partial cross-sectional side view of an embodiment of the thief hatch 14, illustrating self-centering and self-leveling features of the thief hatch 14. As mentioned above, the actuating mechanism 54 applies a downward, axial force on the seal assembly 60. More specifically, the actuating stem 64 of the actuating mechanism 54 exerts an axial, downward force on the center pad 66 of the thief hatch 14. For example, an end 140 of the actuating stem 64 engages with a recess 142 of the center pad 66. In the illustrated embodiment, the end 140 of the actuating stem 64 has an arcuate or convex geometry. Additionally, the recess 142 formed in the center pad 66 has a matching arcuate or concave geometry. As such, the end 140 of the actuating stem 64 and the recess 142 of the center pad 66 engage and mate with one another. In particular, the end 140 of the actuating stem 64 and the recess 142 of the center pad 66 may engage with one another without being completely coaxial. In other words, the engagement between the end 140 of the actuating stem 64 and the recess 142 of the center pad 66 may tolerate a degree of misalignment or tilt. Furthermore, the geometries of the end 140 of the actuating stem 64 and the recess 142 of the center pad 66 may enable a transfer of the downward, axial force in a substantially level and axial direction even if the end 140 of the actuating stem 64 and the recess 142 of the center pad 66 are misaligned or tilted relative to one another.

As mentioned above, the center pad 66 engages with the central extrusion 68 of the seal assembly 60. In particular, a lower portion 144 of the center pad 66 extends within an interior 146 of the central extrusion 68 and engages with an inner diameter 148 of the central extrusion 68. Additionally, a shoulder 150 of an upper portion 152 of the center pad 66 engages with an axial end 154 of the central extrusion 68. In this manner, the center pad 66 transfers the axial, downward force of the actuating stem 64 to the seal assembly 60. Additionally, the engagement between the center pad 66 and the central extrusion 68 enables a centering of the axial, downward force on the seal assembly 60. Specifically, as the center pad 66 engages and mates with the central extrusion 68 in the manner described above, the center pad 66 centers and levels the application of the downward, axial force onto the seal assembly 60. As a result, an even and level sealing interface may be created between the annular lip 62 of the base 50 and the seal assembly 60.

As mentioned above, the thief hatch 14 is configured to vent pressure within the interior 24 of the storage tank 12 when the pressure exceeds a threshold value (e.g., a venting threshold value). To this end, the seal assembly 60 is exposed to the interior 24 of the storage tank 12 through the central opening 114 of the base 50. For example, in the illustrated embodiment, when an internal pressure of the storage tank 12, represented by arrows 156, exceeds a threshold value, the internal pressure acting on the seal assembly 60 (e.g., a sealing disk of the seal) may cause the spring 128 to compress. As the spring compresses 128, the internal pressure forces the seal assembly 60 axially upward, thereby breaking the seal interface between the annular lip 62 of the base 50 and the seal assembly 60. With the seal interface broken, vapor may exit the storage tank 12 through the central opening 114 of the base 50. Once the internal pressure within the storage tank 12 falls below the threshold pressure (e.g., due to vapor venting from the storage tank 12 in the manner described above), the downward, axial force applied to the seal assembly 60 by the actuating mechanism 54 may overcome the upward, axial force applied by the internal pressure of the storage tank 12. As a result, the seal assembly 60 may move axially downward to re-engage with the annular lip 62 of the base 50 and re-establish the sealing interface. As will be appreciated, the stiffness of the spring 128 may be selected to effectuate a desired threshold pressure (e.g., venting threshold pressure) of the storage tank 12. That is, the internal pressure that causes the seal assembly 60 to lift and vent the storage tank 12 in the manner described above may be varied based on the stiffness of the spring 128. Similarly, in embodiments of the actuating mechanism 54 having other actuators, the actuator may be selected or modified to effectuate a desired threshold pressure of the thief hatch 14.

In certain embodiments, the thief hatch 14 may include control, monitoring, and/or other components configured to regulate and/or control operation of the thief hatch 14. For example, in the illustrated embodiment, the actuating mechanism 54 includes a sensor 158 and a controller 160 having a memory 162 and a processor 164 (e.g., a microprocessor). The sensor 158 may be configured to collect feedback (e.g., measured feedback) indicative of one or more operating parameters of the thief hatch 14. For example, the sensor 158 may be a proximity sensor, a position sensor, a flow sensor, a pressure sensor, or other type of sensor. In one embodiment, the sensor 158 may measure a number of venting cycles of the thief hatch 14. In such an embodiment, the number of venting cycles may be stored in the memory 162 of the controller 160, and an operator may retrieve and/or monitor the stored information. As will be appreciated, other measured feedback (e.g., flow rates, pressures, etc.) may be stored within the memory 162. Furthermore, in certain embodiments, the controller 160 may be configured to operate the thief hatch 14 (e.g., automatically). For example, the controller 160 may be configured to operate the actuating mechanism 54 (e.g., an electric actuator) based on feedback measured by the sensor 158. Additionally, venting of the thief hatch 14 may be selectively controlled by an operator using the controller 160. For example, the controller 160 may be configured to operate the actuating mechanism 54 such that the thief hatch 14 vents the storage tank 12 on an interval.

Figure 6:
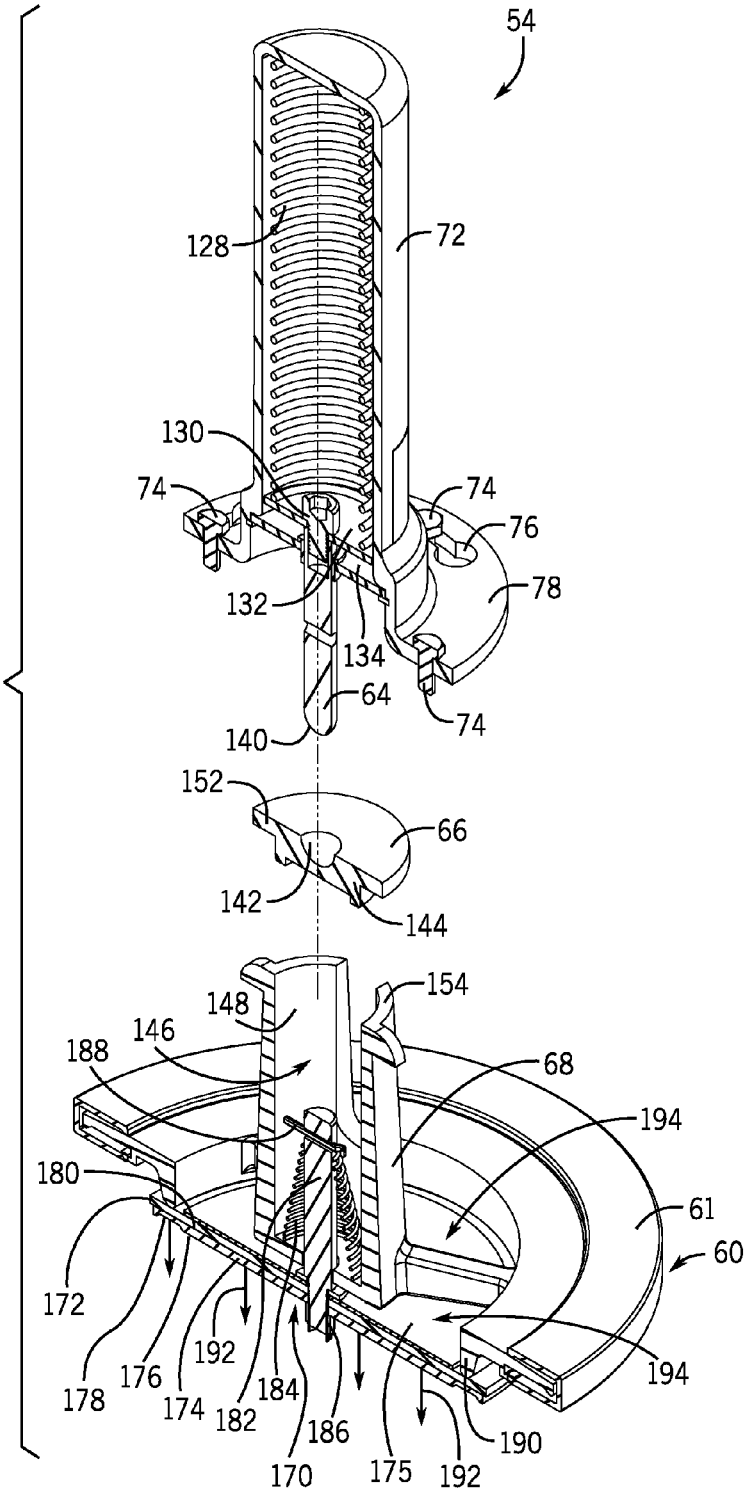
FIG. 6 is a partial cross-sectional perspective view of the thief hatch, in accordance with an embodiment of the present disclosure.

FIG. 6 is a partial cross-sectional perspective view of an embodiment of the thief hatch 14. In the illustrated embodiment, the thief hatch 14 is configured to vent when a vacuum is created within the storage tank 12. Specifically, the seal assembly 60 includes a vacuum seal assembly 170 configured to be exposed to the central opening 114 of the base 50. The vacuum seal assembly 170 includes a vacuum seal 172 disposed between a vacuum pallet 174 and a vacuum seal support 175. The various components of the vacuum seal assembly 170 may be formed from various materials and may have varying configurations. For example, in the illustrated embodiment, the vacuum pallet 174 includes a first side 176 having an annular groove 178 formed thereon and a second side 180 that is substantially flat. Additionally, the second side 180 is disposed adjacent the vacuum seal 172, while the first side 176 is facing the interior 24 of the storage tank 12. As will be appreciated, such a configuration may be suitable for vacuum seal assemblies 170 having soft sealing vacuum seals 172. In another embodiment, the first side 176 with the annular groove 178 may be disposed adjacent the vacuum seal 172, while the second side 180 may face the interior 24 of the storage tank 12. As will be appreciated, such a configuration may be suitable for vacuum seal assemblies 170 having harder vacuum seals 172. Specifically, the annular groove 178 disposed against the vacuum seal 172 may form an air pocket that may improve sealing and performance of the vacuum seal assembly 170.

Furthermore, the vacuum seal assembly 170 is supported by a pallet stem 182 and a vacuum spring 184. More specifically, the vacuum seal assembly 170 is coupled to the pallet stem 182 by a threaded retainer 186. Additionally, the pallet stem 182 and the vacuum spring 184 are disposed within the interior 146 of the central extrusion 68. As shown, the vacuum spring 184 is disposed about the pallet stem 182, and the vacuum spring 184 is restricted by a cotter pin 188, thereby biasing the vacuum seal assembly 170 (e.g., the vacuum seal 172) against an annular rib 190 of the seal assembly 60. In this manner, a sealing interface is created between the vacuum seal assembly 170 and the annular rib 190 of the seal assembly 60. When the internal pressure within the interior 24 of the storage tank 12 exceeds a threshold pressure (e.g., a venting threshold pressure), the vacuum seal assembly 170 is further biased against the annular lip 190 by the internal pressure of the storage tank 12, and the seal assembly 60 may vent the storage tank 12 in the manner described above.

Additionally, the vacuum seal assembly 170 enables venting of the storage tank 12 when a vacuum within the storage tank 12 exceeds a threshold value (e.g., a vacuum threshold value). More specifically, a vacuum within storage tank 12 may exert a force on the vacuum seal assembly 170, as indicated by arrows 192. When the vacuum exceeds a threshold level, the force acting on the vacuum seal assembly 170 may cause the vacuum spring 184 to compress, thereby causing the vacuum seal assembly 170 to translate axially downward. As the vacuum seal assembly 170 translates axially downward, the sealing interface between the vacuum seal assembly 170 (e.g., the vacuum seal 172) and the annular lip 190 of the seal assembly 60 is broken, and a fluid or vapor (e.g., air) may pass into the storage tank 12, as indicated by arrows 194, thereby reducing the vacuum within the storage tank 12.

As discussed in detail above, embodiments of the present disclosure are directed toward the thief hatch 14 for a storage tank (e.g., storage tank 12). For example, in certain embodiments, the thief hatch 14 includes the actuating mechanism 54 that is external to the storage tank 12 when the thief hatch 14 is installed onto the storage tank 12. As such, the actuating mechanism 54 may be maintained, removed, and/or replaced, while maintaining a sealing relationship between the thief hatch 14 and the storage tank 12 (e.g., without opening the thief hatch 14). Additionally, the actuating mechanism 54 may includes features that enable the seal assembly 60 (e.g., seal assembly) of the thief hatch 14 to be self-leveling and seal-centering. As a result, an even, axially downward force on the seal assembly 60 may be maintained, thereby improving the sealing interface between the seal assembly 60 and the base 50 of the thief hatch 14. Furthermore, the thief hatch 14 may have a quick release mechanism, such as the scored clevis pin 108, configured to actuate when an internal pressure of the storage tank 12 exceeds an elevated threshold pressure (e.g., a threshold pressure greater than the venting threshold pressure that actuates venting of the storage tank 12 by the thief hatch 14).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

ELEMENT LIST

10
12
14
16
18
20
22
24
26
28
30
32
34
36
38
40
42
44
46
48
50
52
54
56
58
60
62
64
66
68
70
72
74

76
78
80
82
84
86
88
90
92

The invention claimed is:

1. A system, comprising:

a thief hatch, comprising:

a base configured to couple to a storage container, wherein the base comprises a central opening configured to be exposed to an opening of the storage container;

a cap coupled to the base;

a seal disposed between the base and the cap; and an actuating mechanism configured to exert a biasing force on the seal to bias the seal against an annular lip of the base, wherein the actuating mechanism comprises a center pad and an actuating stem arranged to engage the center pad to transfer the biasing force to the seal, and wherein the actuating mechanism is disposed on an exterior surface of the cap and is removable from the exterior surface while maintaining a sealing interface between the seal and the annular lip.

2. The system of claim 1, wherein the cap is coupled to the base by a hinge spring, and the hinge spring is configured to enable rotating of the cap about the base.

3. The system of claim 2, wherein the cap is releasably secured to the base by a latch of the cap, wherein the latch is configured to engage with a latch pin of the base in a closed position.

4. The system of claim 3, wherein the latch pin comprises a plurality of indentions configured to shear when the seal is exposed to a threshold force.

5. The system of claim 1, wherein the actuating mechanism comprises a spring configured to generate the biasing force.

6. The system of claim 1, wherein the actuating stem comprises a convex end, the center pad comprises a concave recess, and the convex end and the concave recess engage with one another to transfer the biasing force from the actuating mechanism to the seal.

7. The system of claim 1, wherein the center pad comprises a shoulder configured to engage with an axial end of a central extrusion of the seal when the actuating mechanism transfers the biasing force to the seal.

8. The system of claim 7, wherein the center pad comprises a lower portion configured to be disposed within an interior of the central extrusion, and the lower portion comprises a diameter that engages with an inner diameter of the interior.

9. A venting hatch, comprising:

a base comprising an annular lip defining a central opening, wherein the central opening is configured to be in fluid communication with an interior of a container;

a lid coupled to the base by a hinge;

a seal assembly disposed between the base and the lid, wherein the seal assembly is configured to abut the annular lip to create a sealing interface; and an actuating mechanism coupled to a side of the lid opposite the seal assembly, wherein the actuating mechanism is configured to exert a biasing force on the seal assembly toward the annular lip and to be removable from the side of the lid without decoupling the lid from the base.

10. The venting hatch of claim 9, wherein the actuating mechanism comprises a spring disposed within a shell extending axially outward from the lid.

11. The venting hatch of claim 10, wherein the seal assembly comprises a circular surface configured to be exposed to the central opening of the base and the interior of the container.

12. The venting hatch of claim 11, wherein the spring is configured to compress within the shell when an internal pressure of the interior of the container exceeds a threshold pressure.

13. The venting hatch of claim 9, wherein the seal assembly comprises:

a sealing disk configured to abut the annular lip;

a central extrusion extending axially from the sealing disk toward the lid; and a vacuum pallet disposed on a side of the sealing disk opposite the central extrusion.

14. The venting hatch of claim 13, wherein the seal assembly comprises a vacuum pallet stem coupled to the vacuum pallet and disposed at least partially within an interior of the central extrusion, a vacuum spring disposed about the vacuum pallet stem and within the interior of the central extrusion, and a pin configured to retain the vacuum spring about the vacuum pallet stem.

15. A system, comprising:

a storage container, comprising:

an interior volume; and an opening exposing the interior volume to an environment surrounding the storage container; and a venting hatch, comprising:

a base coupled to the storage container about the opening, wherein the base comprises a central passage in fluid communication with the opening;

a cap hinged to the base, wherein the cap is configured to expose the opening in an open position and block the opening in a closed position;

a seal assembly disposed between the base and the cap, wherein the seal assembly is configured to create a sealing interface with base to seal the central passage; and an actuating mechanism coupled to an exterior side of the cap via at least one coupling mechanism accessible from the exterior side of the cap, wherein the actuating mechanism is configured to apply an axial biasing force on the seal assembly, and wherein the actuating mechanism comprises a center pad and an actuating stem arranged to engage the center pad to transfer the axial biasing force to the seal assembly.

16. The system of claim 15, wherein the sealing interface is configured to be broken when an internal pressure of the interior volume generates a force on the seal assembly that exceeds the axial biasing force.

17. The system of claim 15, wherein the actuating mechanism is configured to decouple from the cap while the sealing interface between the seal assembly and the base is maintained.

18. The system of claim 15, wherein the actuating mechanism is configured to decouple from the cap while the cap is in the closed position.

19. The system of claim 15, wherein the venting hatch comprises at least one sensor configured to measure a position of the seal assembly, an internal pressure of the interior volume, a venting flow rate of the venting hatch, a number of venting cycles of the venting hatch, or a combination thereof.

20. The system of claim 1, wherein the center pad is configured to engage the seal to transfer the biasing force to the seal.

* * * * *